US012037898B2

(12) United States Patent
De Gennaro et al.

(10) Patent No.: US 12,037,898 B2
(45) Date of Patent: Jul. 16, 2024

(54) SYSTEM AND METHOD FOR EVALUATING STATIC ELASTIC MODULUS OF SUBTERRANEAN FORMATION

(71) Applicant: Schlumberger Technology Corporation, Sugar Land, TX (US)

(72) Inventors: Vincenzo De Gennaro, Pau (FR); Cosan Ayan, Istanbul (TR); Claude Signer, Sugar Land, TX (US); Tomas Primitivo Bustos Cruz, Aberdeenshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 17/594,082

(22) PCT Filed: Apr. 3, 2020

(86) PCT No.: PCT/US2020/026644

§ 371 (c)(1),
(2) Date: Oct. 1, 2021

(87) PCT Pub. No.: WO2020/206303

PCT Pub. Date: Oct. 8, 2020

(65) Prior Publication Data

US 2022/0178251 A1 Jun. 9, 2022

Related U.S. Application Data

(60) Provisional application No. 62/828,787, filed on Apr. 3, 2019.

(51) Int. Cl.
*E21B 49/00* (2006.01)
*E21B 47/06* (2012.01)

(52) U.S. Cl.
CPC ..... *E21B 49/006* (2013.01); *E21B 47/06* (2013.01)

(58) Field of Classification Search
None
See application file for complete search history.

(56) References Cited

U.S. PATENT DOCUMENTS 4,149,409 A * 4/1979 Serata ..... E21B 49/006 73/152.59
4,899,320 A * 2/1990 Hearn ..... E21B 47/02 73/152.59
5,253,519 A * 10/1993 Muschotti ..... E21B 49/006 73/152.52

(Continued)

FOREIGN PATENT DOCUMENTS

FR 2496751 A1 6/1982
WO 2010083166 A2 7/2010
WO 2011139570 A2 11/2011

OTHER PUBLICATIONS

Rangeard, D., Y. Hicher, P. and Zentar, R. (2003), Determining soil permeability from pressuremeter tests. Int. J. Numer. Anal. Meth. Geomech., 27: 1-24. https://doi.org/10.1002/nag.258 (Year: 2003).*

(Continued)

*Primary Examiner* — Lina Cordero
(74) *Attorney, Agent, or Firm* — Jeffrey D. Frantz

(57) ABSTRACT

A method that includes lowering a formation testing tool into a wellbore intersecting a subterranean formation. The formation testing tool comprises an expandable member. The method also includes performing a pressuremeter test (PMT) by expanding the expandable member.

12 Claims, 10 Drawing Sheets

(56) References Cited

U.S. PATENT DOCUMENTS

| | | | | |
|---|---|---|---|---|
| 5,353,637 | A | 10/1994 | Plumb et al. | |
| 5,784,333 | A | 7/1998 | Tang et al. | |
| 6,213,217 | B1 * | 4/2001 | Wilson | E21B 33/127 166/387 |
| 2004/0237640 | A1 | 12/2004 | Meister et al. | |
| 2006/0090905 | A1 * | 5/2006 | Brennan, III | E21B 33/1216 166/387 |
| 2009/0164128 | A1 | 6/2009 | Tchakarov et al. | |
| 2010/0051347 | A1 * | 3/2010 | Tchakarov | E21B 49/06 175/50 |
| 2010/0206548 | A1 | 8/2010 | Pisio et al. | |
| 2015/0136388 | A1 | 5/2015 | Fehr | |
| 2018/0334903 | A1 | 11/2018 | Lehr et al. | |

OTHER PUBLICATIONS

Sedran G., et al., Relationship Between Menard EM and Young's E Moduli for Cohesionless Soils, Proceedings of the 18th International Conference on Soil Mechanics and Geotechnical Engineering, Paris (Year: 2013).*

Recommended Practice for Design and Installation of Offshore Production Platform Piping Systems, American Petroleum Institute. RP 14 E, 1991, Reaffirmed 2013, 62 pages.

Yu, H.-S. "Cavity Expansion Theory and its Application to the Analysis of Pressuremeter". PhD thesis, 1990, University of Oxford, 183 pages.

Standard Test Methods for Prebored Pressuremeter Testing in Soils, ASTM D4719, 2007, 10 pages.

International Search Report and Written Opinion received in PCT Application PCT/US2020/026644, dated Jul. 23, 2020 (10 pages).

International Preliminary Report on Patentability received in PCT Application PCT/US2020/026644, dated Oct. 14, 2021 (9 pages).

Extended Search Report issued in European Patent Application No. 20782160.4 dated Nov. 3, 2022, 6 pages.

Briaud J-L. 1992. The Pressuremeter. Taylor and Francis, pp. 1-9, 22-33, 46-51, and 56-61.

* cited by examiner

SYSTEM AND METHOD FOR EVALUATING STATIC ELASTIC MODULUS OF SUBTERRANEAN FORMATION

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a national stage entry under 35 U.S.C. 371 of International Application No. PCT/US2020/026644, filed Apr. 3, 2020 and claims priority to and the benefit of U.S. Provisional Application No. 62/828,787, filed Apr. 3, 2019, the entirety of which is incorporated by reference herein and should be considered part of this specification.

BACKGROUND

This disclosure relates generally to downhole tools and more specifically to tools for evaluating static elastic modulus of subterranean formation.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

BRIEF DESCRIPTION OF THE DRAWINGS

Various aspects of this disclosure may be better understood upon reading the following detailed description and upon reference to the drawings in which.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Formation testing provides information about the properties of a subsurface formation such as the minimum horizontal stress, which may be useful for optimizing the extraction of oil and gas from a subsurface formation. During formation testing, a downhole tool is inserted into a wellbore and different tests can be conducted on the subsurface formation while the downhole tool is positioned in the wellbore.

In some instances, it is desirable to conduct one or more pressuremeter tests (PMT) with the downhole tool in the wellbore. In some embodiments, a PMT test may comprise inflating an inflatable probe or packer to expand the probe or packer against the wall of the wellbore to induce an outward radial deformation. Accordingly, the present disclosure provides an efficient solution to perform PMT tests that may be used as an alternative or in addition to certain conventional techniques. Aspects in accordance with the present disclosure may be applied to, for example, cases where the formation is normally consolidated or unconsolidated. Embodiments of the present disclosure may include downhole tools with double packers (e.g. straddle packers) or single packer.

Figure 1:
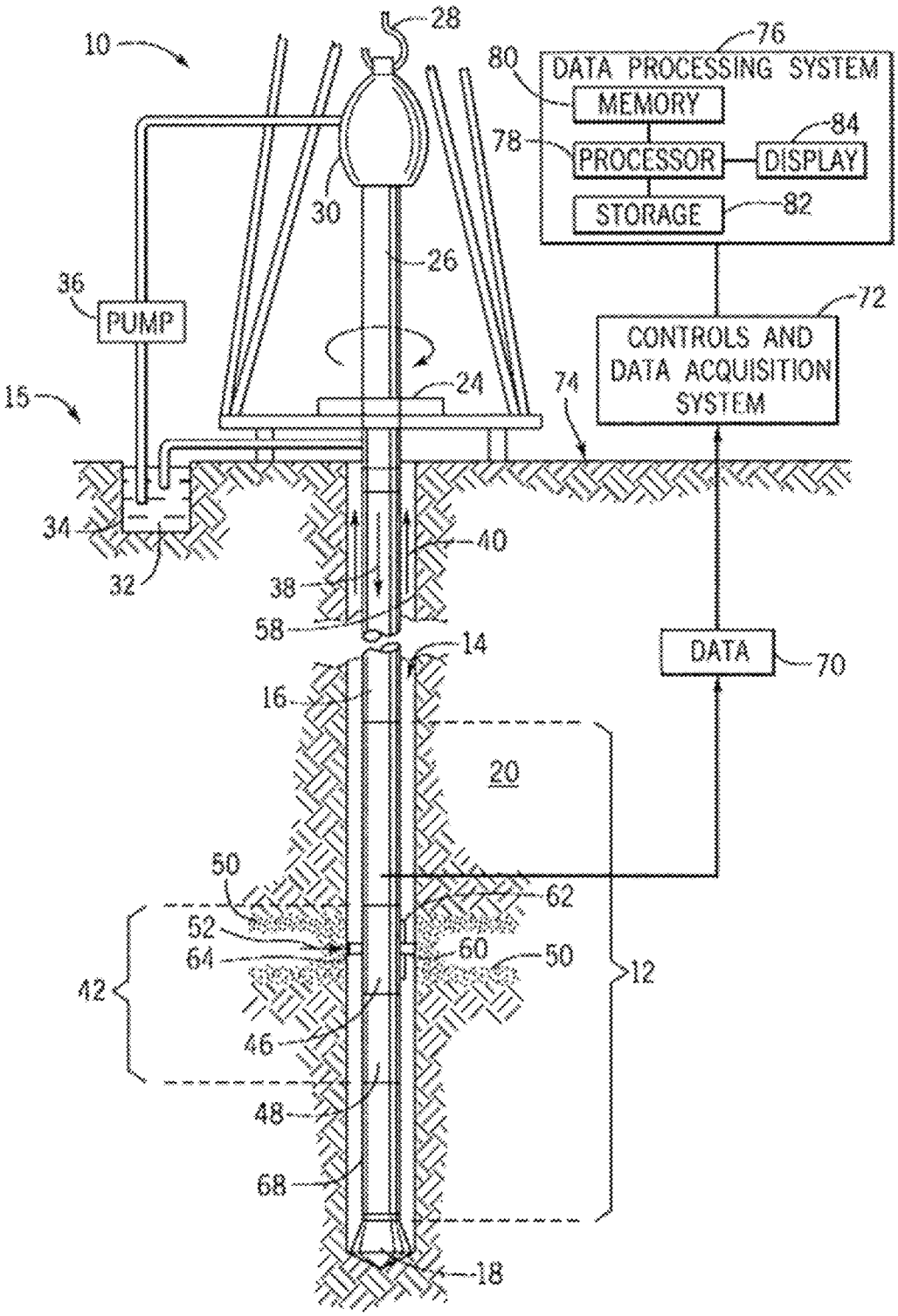
FIG. 1 depict examples of wellsite systems that may employ the formation tester and techniques described herein.
Figure 2:
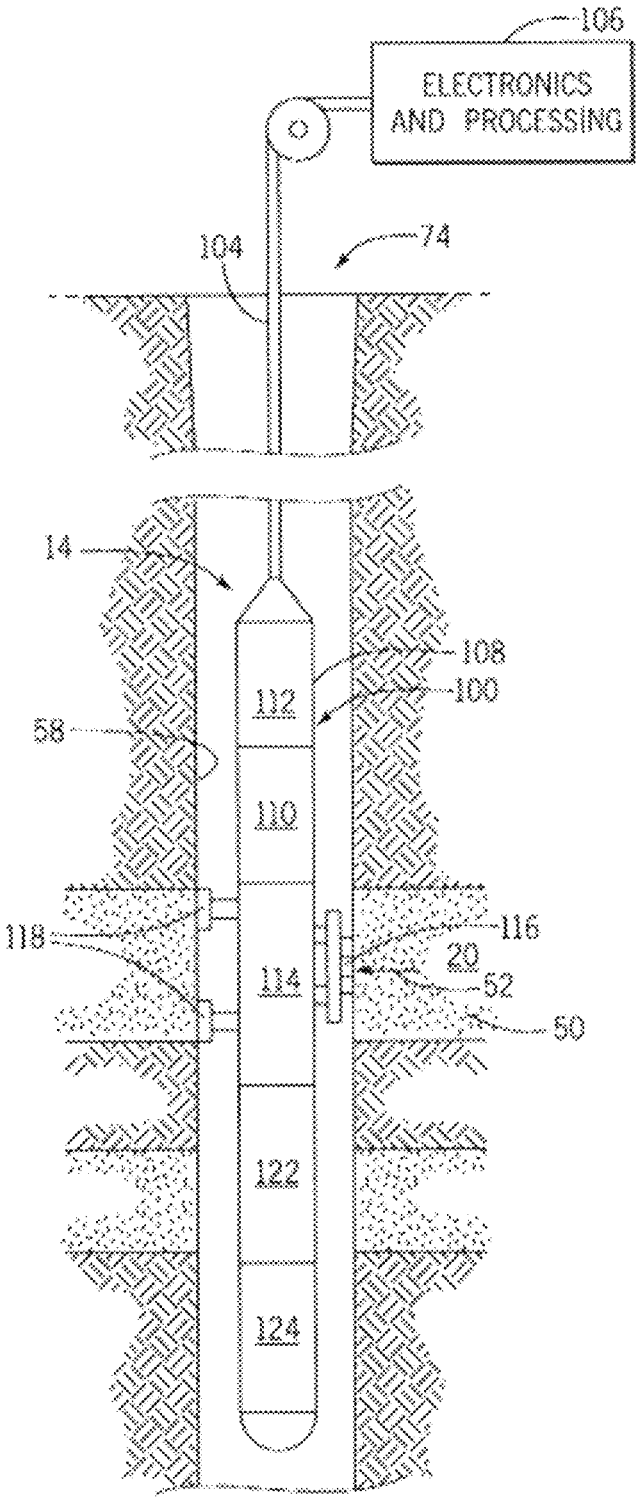
FIG. 2 depict examples of wellsite systems that may employ the formation tester and techniques described herein.

With the foregoing in mind, FIGS. 1 and 2 depict examples of wellsite systems that may employ the formation tester and techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Formation fluid or mud 32 (e.g., oil base mud (OBM) or water-based mud (WBM)) is stored in a pit 34 formed at the well site. A pump 36 delivers the formation fluid 32 to the interior of the drill string 16 via a port in the swivel 30, inducing the drilling mud 32 to flow downwardly through the drill string 16 as indicated by a directional arrow 38. The formation fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the downhole acquisition tool 12 includes a downhole analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based at least in part on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, minimum horizontal stress, etc.), calculating and estimating fluid properties of the reservoir fluid 50, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 50, respectively. In certain embodiments, the data processing system 76 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 15.

FIG. 2 depicts an example of a wireline downhole tool 100 that may employ the systems and techniques described herein to determine formation and fluid property characteristics of the reservoir 15. The wireline downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The wireline downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe or packer 116 and backup pistons 118 that are arranged on opposite sides of the elongated body 108. The extendable probe or packer 116 is configured to selectively seal off or isolate selected portions of the wall 58 of the wellbore 14 to fluidly couple to the adjacent geological formation 20 and/or to draw fluid samples 52 from the geological formation 20. The extendable probe or packer 116 may include a single inlet or multiple inlets designed for guarded or focused sampling. The reservoir fluid 50 may be expelled to the wellbore through a port in the body 108 or the reservoir fluid 50 may be sent to one or more modules 122 and 124. The modules 122 and 124 may include sample chambers that store the reservoir fluid 50. In the illustrated example, the electronics and processing system 106 and/or a downhole control system are configured to control the extendable probe or packer 116 and/or the drawing of a fluid sample from the formation 20 to enable analysis of the fluid properties of the reservoir fluid 50, as discussed above.

In some embodiments, the module 114 may be used for formation testing. For example, it may be desirable to conduct one or more pressuremeter tests (PMT) with the downhole tool in the wellbore. In some embodiments, a PMT test may comprise inflating an inflatable probe or packer 116 to expand the probe or packer 116 against the wall of the wellbore to induce an outward radial deformation. One or more of the extendable probes or packers 116 may be used to deform radially the geological formation 20, increasing the number of points where measurements are taken. The extendable probes or packers 116 may be coupled to one or more formation testing module 122 and/or 124, which determine a property of the formation.

Figure 3:
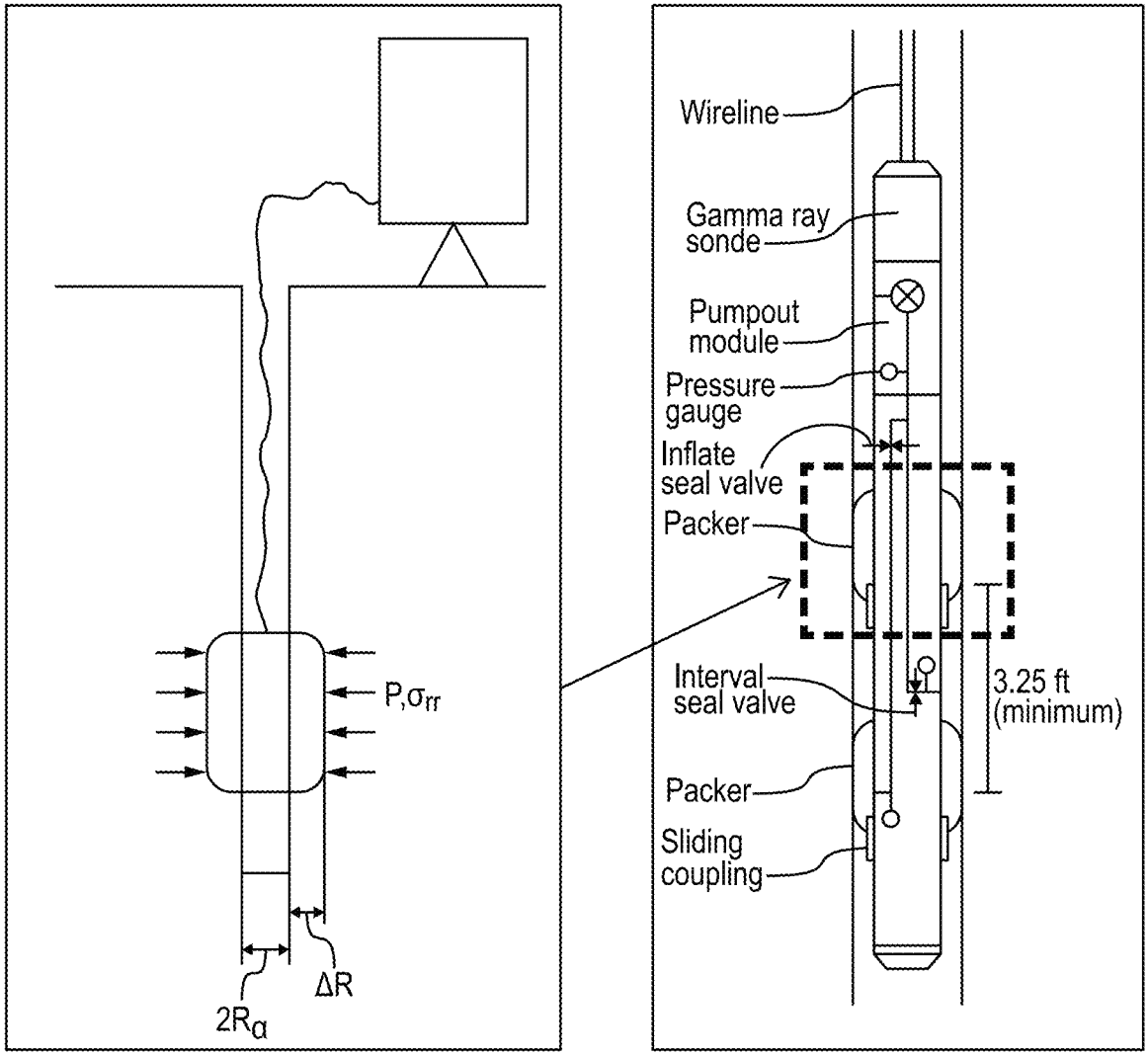
FIG. 3 is a schematic diagram illustrating a traditional PMT test (in comparison to an embodiment of the current application which uses a formation testing module of the downhole tool 100 to perform a PMT test.

A PMT test can be run under pressure controlled conditions (constant pressure rate) or strain controlled conditions (constant volume rate). The PMT test supports shallow and deep foundations design (onshore and offshore) by providing elastic and strength geomechanical parameters such as: pressuremeter modulus, shear static modulus, limit expansion pressure, shear strength. The shear static modulus is of particular interest for formation characterization since it is a static property derived from a direct measurement downhole. A modular formation testing tool with probe/packer(s) can be used to conduct PMT tests because it possesses the geometrical and mechanical attributes, for example a long cylindrical membrane in single or multiple packers, that are capable of expansion to deform the surrounding soil/rock mass. FIG. 3 is a schematic diagram illustrating a traditional PMT test (left, after Briaud, 1992) in comparison to an embodiment of the current application which uses a formation testing module 122 of the downhole tool 100 to perform a PMT test (right).

Accordingly, the current application discloses a tool or system and procedures associated thereof to perform PMT tests to assess in situ static elastic properties of consolidated and unconsolidated rock formations using a wireline formation testing tool. The analysis and design of the current tool and procedure can be of great benefit for the general deployment of engineering solutions associated to PMT testing. In embodiments, the analysis can be carried out by inspecting the packer pressure vs. pumped volume in a Sleeve Fracture Plot, before inducing irreversible formation deformations such as tangential plastic yielding and/or plastic tensile failure. Compared to the traditional PMT test, one advantage of the current application is the possibility to reproduce by means of an in situ nondestructive test a mechanical problem that can be fully tackled using the well-known cavity expansion theory.

The combined use of test results from a formation testing tool and the cavity expansion theory approach can allow inferring rock in situ elastic and strength properties in a very short period of time such as a few hours. The derived information can be used for multiple applications, including but not limited to, geomechanical parameters calibration, formation characterization, local (packer level) stress analysis, evaluation of formation damage in conjunction with acoustic emissions measurements, influence of near wellbore stress changes induced by packers on fracture inception.

Figure 4:
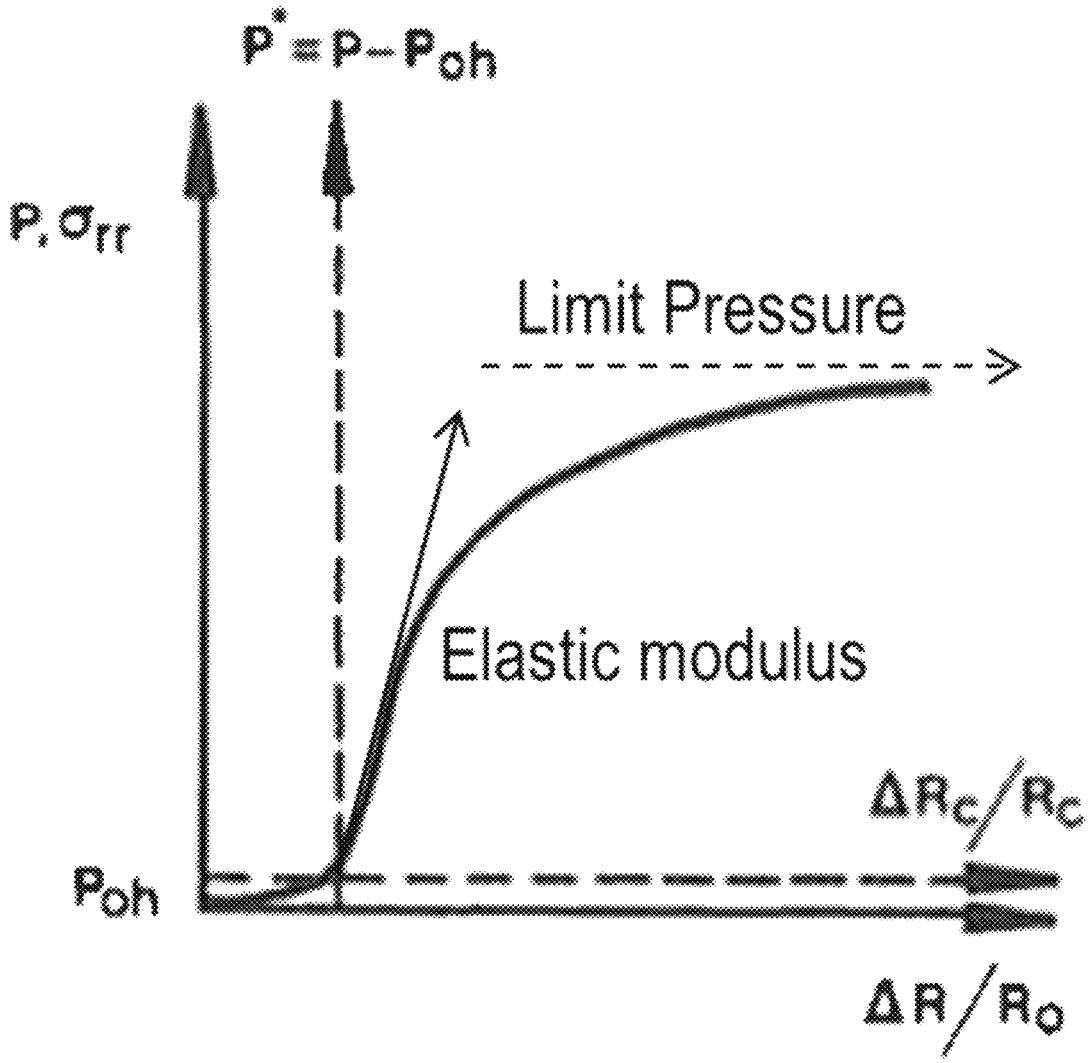
FIG. 4 illustrates one method of using the Sleeve Fracture Plot (packer pressure vs. pumped volume) to derive information on rock mechanics properties.
Figure 5:
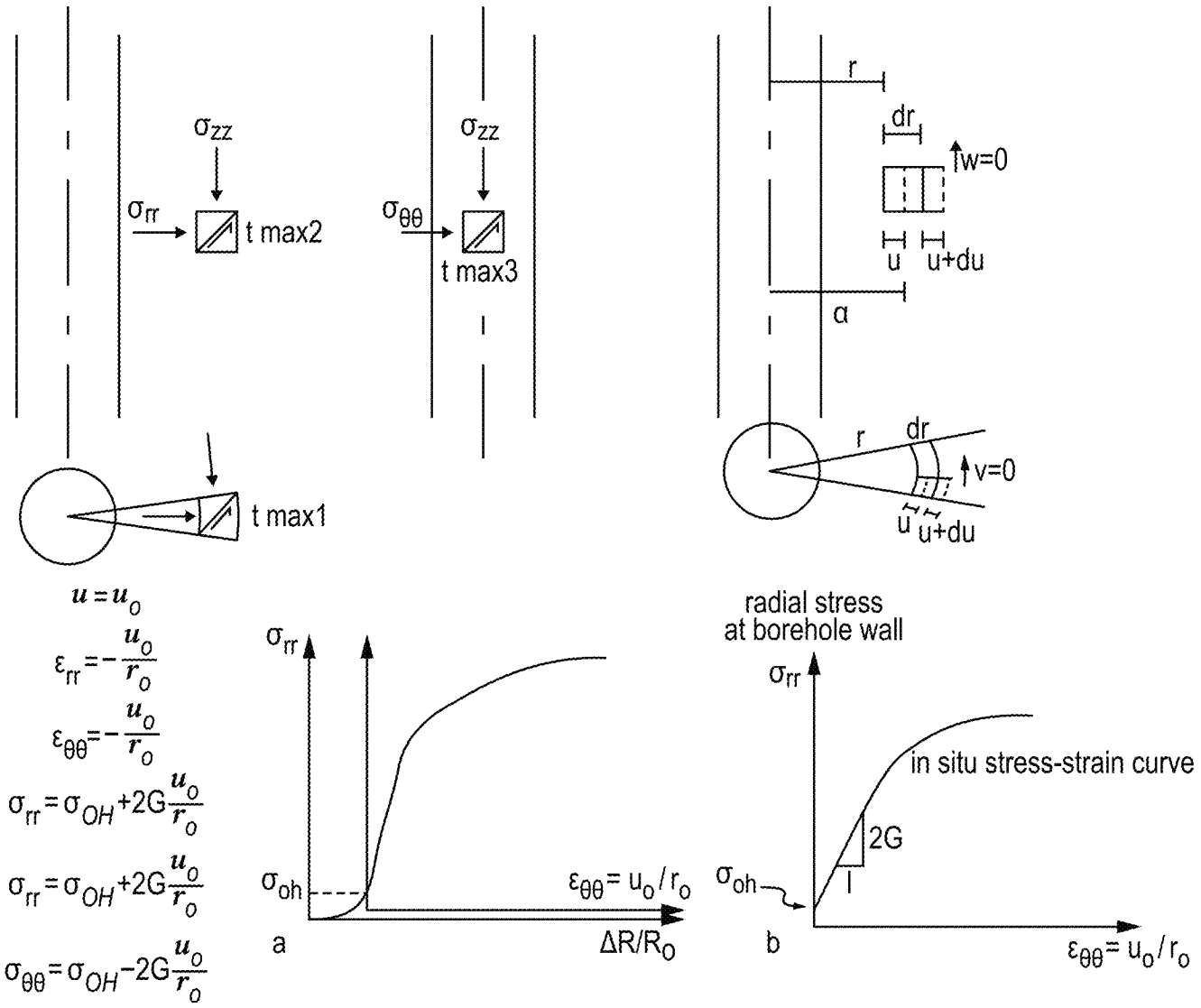
FIG. 5 depicts means of the cavity expansion theory.

FIG. 4 (adapted from Briaud, 1992) illustrates one method of using the Sleeve Fracture Plot (packer pressure vs. pumped volume) to derive information on rock mechanics properties. FIG. 4 shows one possible procedure to perform a PMT test and an exemplary result of a PMT test in soils. Two slopes can be used to characterize the elastic modulus (subvertical arrow) and the limit (failure) pressure (horizontal arrow). By means of the cavity expansion theory (FIG. 5 Top, adapted from Briaud, 1992), the PMT curve can be used to derive the static shear modulus G (FIG. 5 Bottom, adapted from Briaud, 1992). Additional parameters that can be derived from PMT test include but are not limited to: $K_0$ (coefficient of earth pressure at rest, which can be further used in isotropic elasticity $K_0=v/(1-v)$ to derive v=Poisson's ratio), PMT modulus $E_0$ and reload modulus $E_r$ (for a given Poisson's ratio), Yield, Limit and Net Limit pressures ($P_Y$, $P_L$, P*), Standard soils classification (e.g. ASTM) based on ratio $E_0/P^*$ (also used for test quality check), friction angle, coefficient of radial consolidation, tensile strength, and pre-consolidation pressure.

Figure 6:
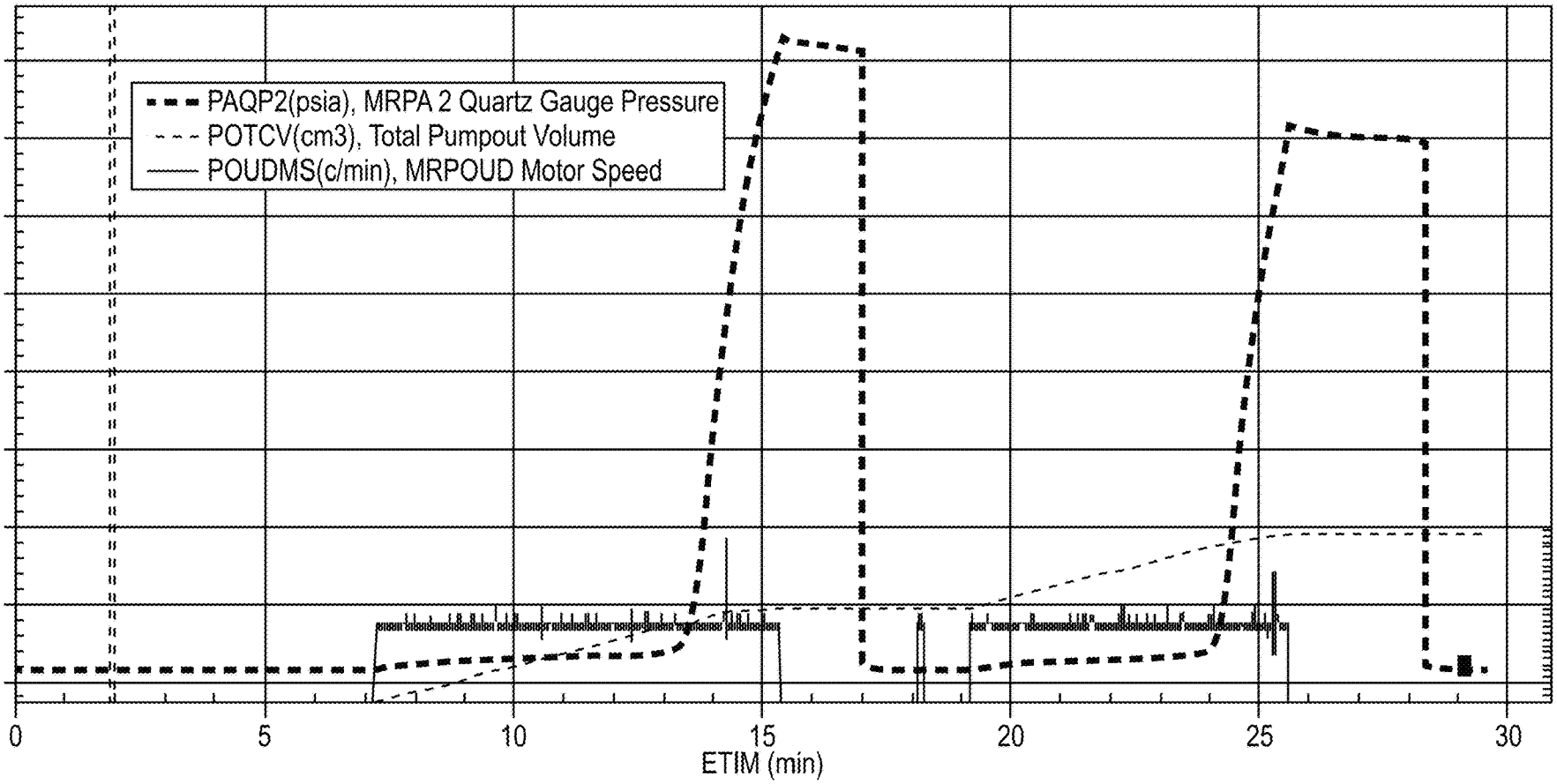
FIG. 6 depicts example of a sleeve fracture plot with two packer inflation phases.
Figure 7:
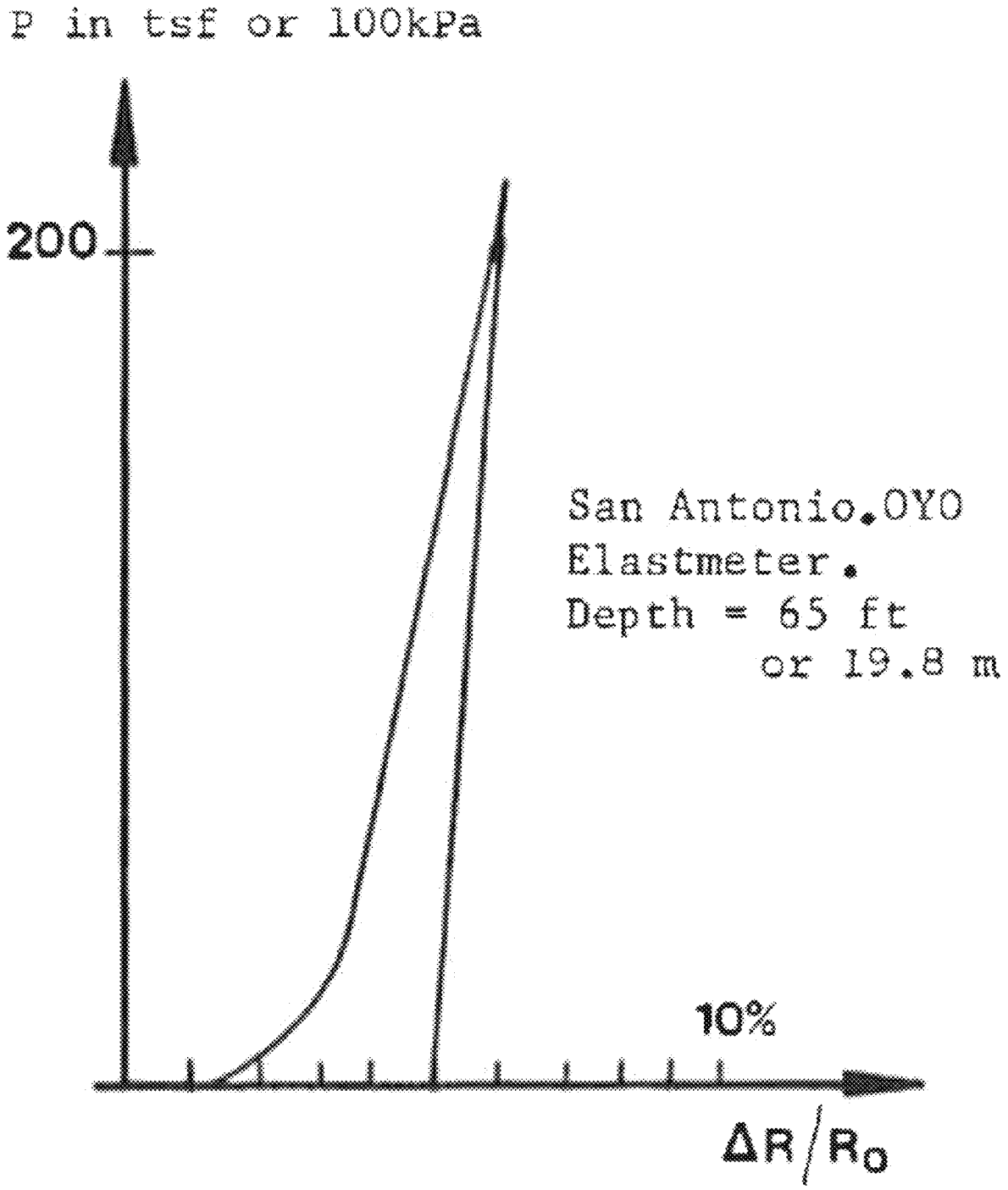
FIG. 7 depicts an example curve from a PMT.

One example of a sleeve fracture plot with two packer inflation phases is presented in FIG. 6. A similar curve from PMT is shown in FIG. 7 (after Briaud, 1992). The slope of the linear part plotted as a function of the pumped volume can be interpreted following the scheme presented in FIG. 5 and can provide the value of the static shear modulus G.

Figure 8:
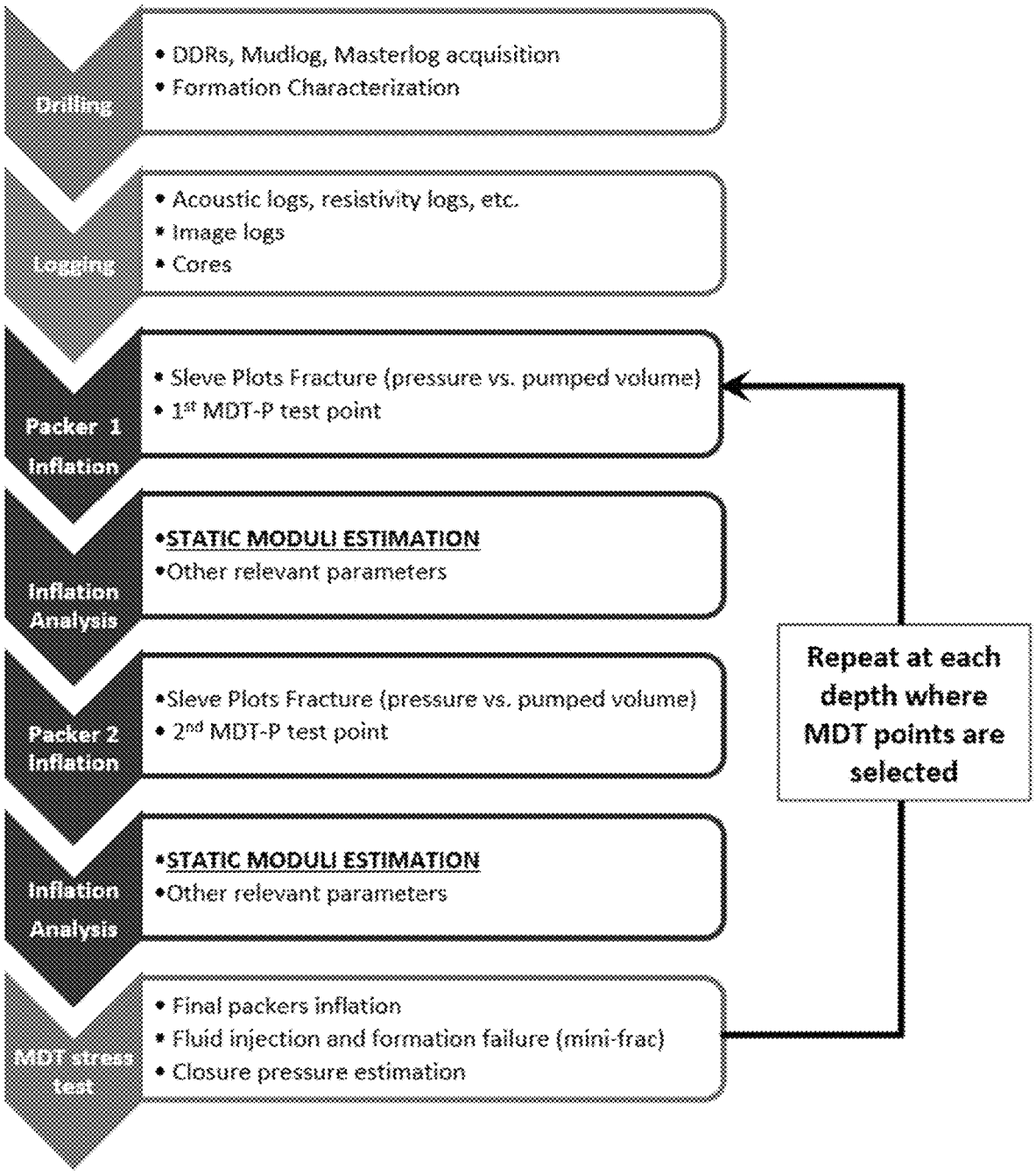
FIG. 8 depicts an example workflow.

Embodiments of the current application also comprise the workflow as illustrated in FIG. 8. It enables the exploitation of data from the packer inflation in order to derive elastic static properties directly down-hole within an extremely short period (e.g. a few hours). Currently the typical time necessary to obtain similar information is of the order of months since static mechanical properties are obtained by means of laboratory tests on samples extracted from cores.

Embodiments of the current application may further comprise a real time (RT) interface developed as a standalone application or a module extension in a platform acquisition software program, enabling the interpretation of the packer(s) inflation phases in terms of packers pressure vs. injected volume (P-V inflation curves).

The module allows the application of theoretical solution derived from the cavity expansion theory (e.g. Yu, H-S 1990) by means of a numerical analysis. One embodiment of the solution is shown as a curve in FIG. 9. This curve can also serve as a quality control indicator of the in-situ conditions with respect to the expected theoretical solution.

Figure 9:
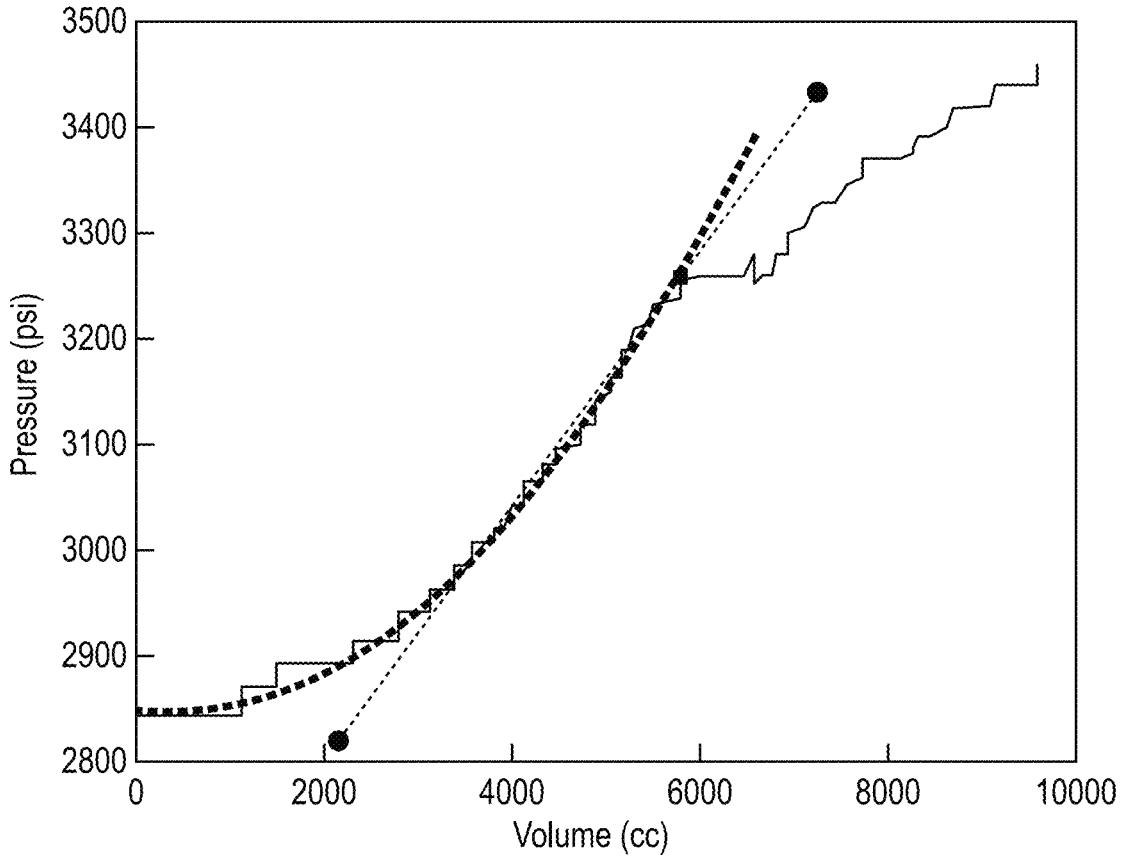
FIG. 9 solution derived from the cavity expansion theory.
Figure 10:
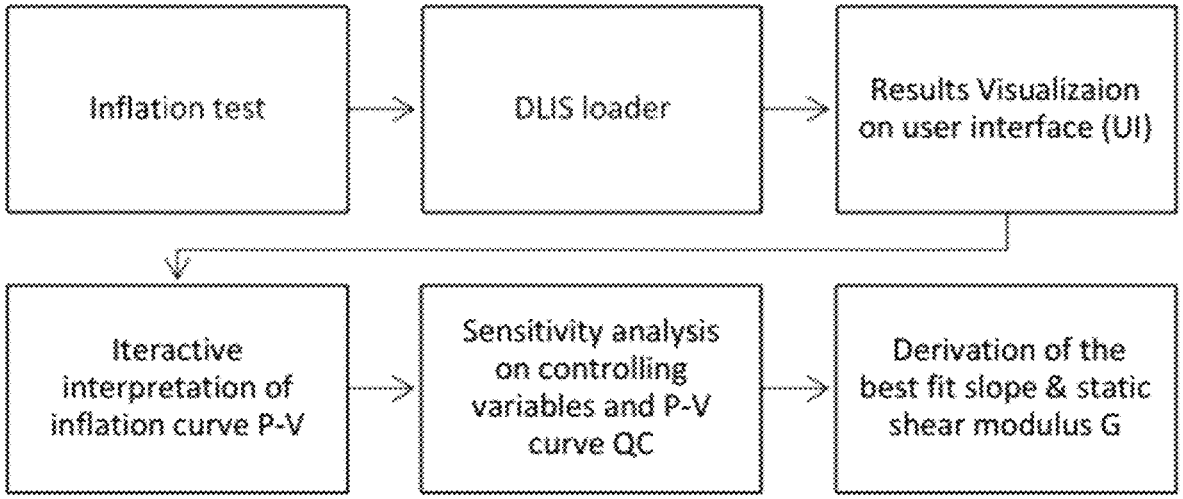
FIG. 10 example of a high level workflow of interpretation software.

The module may also allow drawing various secant slopes of the pressure-volume inflation curve, extracting the most suitable value of the slope (equal to 2G, being G the static elastic shear modulus) that minimize the error of the proposed interpolation (e.g. the straight line in FIG. 9). One example of the high level workflow of the interpretation software is illustrated in FIG. 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The following references are incorporated into the specification of the current application in their entireties:

[1] Briaud J-L. 1992. The pressuremeter. Taylor and Francis, 336 p.

[2] Yu, H-S 1990. Cavity expansion theory and its application to the analysis of pressuremeters. PhD thesis, University of Oxford.

[3] Règles techniques de calcul et de conception des fondations des ouvrages de genie civil. Cahier des clauses techniques générales applicables aux marches des travaux. Fascicule 62, titre V, 1993. Ministere de l'Equipement du Logement et des Transports.

[4] Essai pressiometrique Menard. Norme française NF P 94-110, juillet 1991, AFNOR Paris.

[5] American Petroleum Institute. RP 14 E. Recommended practice for design and installation of offshore production platform piping systems.

[6] Standard tests methods for prebored pressuremeter testing in soils. ASTM D 4719.

The invention claimed is:

1. A method comprising:

lowering a formation testing tool into a wellbore intersecting a subterranean formation, wherein the formation testing tool comprises a first expandable member and a second expandable member;

performing a first pressuremeter test (PMT) by expanding the first expandable member; and after performing the first PMT, performing a second PMT by expanding the second expandable member.

2. The method of claim 1, wherein the formation testing tool is a wireline tool.

3. The method of claim 1, wherein the first expandable member and the second expandable member are each a packer inflated by downhole pumps.

4. The method of claim 1, further comprising considering proper tool calibration and packer selection as a function of formation stiffness before test execution.

5. The method of claim 1, further comprising analyzing data from the first PMT and the second PMT using a cavity expansion theory.

6. The method of claim 5, further comprising validating interpretation of the analyzed data from the first PMT and the second PMT using rock mechanics laboratory tests results.

7. The method of claim 1, further comprising integrating acoustic based estimation of dynamic elastic properties, comprising isotropic and anisotropic properties from wireline logging in order to establish appropriate dynamic-to-static transforms and support geomechanical properties and stress modelling.

8. The method of claim 1, further comprising providing pressure data and pumped volume data obtained during the first PMT to a processor configured to generate a sleeve fracture plot, wherein one slope characterizes an elastic modulus and a second slope characterizes a limit pressure.

9. The method of claim 8, wherein the processor is further configured to use cavity expansion theory to generate an in situ stress-strain curve from the data obtained from the first PMT and derive a static shear modulus therefrom.

10. A method comprising:

lowering a formation testing tool into a wellbore intersecting a subterranean formation, wherein the formation testing tool comprises a first expandable packer and a second expandable packer;

performing a first pressuremeter test (PMT) test at a first depth, comprising inflating the first expandable packer, and acquiring first pressure and pumped volume data, and communicating the acquired first pressure and pumped volume data to a processor, wherein the processor is configured to plot a first sleeve fracture plot;

after performing the first PMT, performing a second PMT test by inflating the second expandable packer, and acquiring second pressure and pumped volume data, and communicating the acquired second pressure and pumped volume data to the processor, wherein the processor is configured to plot a second sleeve fracture plot; and using the processor to derive a first static shear modulus using the first sleeve fracture plot and a second static shear modulus using the second sleeve fracture plot.

11. The method of claim 10, wherein the formation testing tool is a wireline tool.

12. The method of claim 10, wherein the first static shear modulus is derived by analyzing the first sleeve fracture plot using a cavity expansion theory.

* * * * *